US007070210B2

(12) United States Patent
Lin

(10) Patent No.: US 7,070,210 B2
(45) Date of Patent: Jul. 4, 2006

(54) FIRE-BLOCKING DOOR LOCK STRUCTURE

(76) Inventor: Ching-Tien Lin, No. 2, Lane 112, Chu-Yuan Road, Hsin-Chung, Taipei Hsien (TW)

( * ) Notice: Subject to any disclaimer, the term of this patent is extended or adjusted under 35 U.S.C. 154(b) by 64 days.

(21) Appl. No.: 10/692,932

(22) Filed: Oct. 27, 2003

(65) Prior Publication Data

US 2004/0183311 A1 Sep. 23, 2004

(30) Foreign Application Priority Data

Mar. 17, 2003 (TW) ..... 92204038 U

(51) Int. Cl.
*E05B 65/10* (2006.01)

(52) U.S. Cl. ..... 292/93; 292/92; 292/DIG. 65

(58) Field of Classification Search ..... 292/92, 292/93, DIG. 65; 70/92
See application file for complete search history.

(56) References Cited

U.S. PATENT DOCUMENTS 4,598,939 A * 7/1986 Krupicka et al. ..... 292/92
4,709,950 A * 12/1987 Zortman ..... 292/92
4,747,629 A * 5/1988 Miller ..... 292/92
4,824,150 A * 4/1989 Smith et al. ..... 292/92
5,890,752 A * 4/1999 Lin ..... 292/92
6,205,825 B1 * 3/2001 Haeck et al. ..... 70/92

* cited by examiner

*Primary Examiner*—Gary Estremsky
(74) *Attorney, Agent, or Firm*—Shoemaker and Mattare

(57) ABSTRACT

A fire-blocking door lock structure includes a latching member mounted on a fire-blocking door lock and an actuation mechanism mounted in the latching member. The actuation mechanism includes a latch body having a stop portion; a stop piece which prevents retraction of the latch body and is connected to a fire-blocking piece; a safety latching member which prevents the latch body from retraction into the latching member when the safety latching member abuts against the stop piece; a guide rod for allowing the latch body to be blocked by the fire-blocking piece when the safety latching member abuts against the stop piece; and an actuating piece. When the fire-blocking piece melts under a high temperature during a fire, the stop piece blocks the stop portion, such that the latch body cannot be retracted into the latching member, keeping the fire-blocking door locked.

15 Claims, 7 Drawing Sheets

FIRE-BLOCKING DOOR LOCK STRUCTURE

FIELD OF THE INVENTION

The present invention relates to fire-blocking door lock structures, and more particularly, to an improved fire-blocking door lock structure comprising an actuation mechanism having a latch body and a safety latching member, to assure lockup of the fire-blocking door during a fire.

BACKGROUND OF THE INVENTION

A conventional fire-blocking door lock structure as shown in FIG. 1 shows that a fire-blocking door lock 1 can be unlatched when a person presses a push handle 10*a* mounted on a frame member 10 that is horizontally mounted on the center of the fire-blocking door 2. When the push handle 10*a* is pressed down, a latch body 11 is withdrawn into the inside of a casing 3, unlatching the fire-blocking door lock 1.

To make the structure of the fire-blocking door lock 1 more understandable, the fire-blocking door lock 1 is rotated by 90 degrees such that the back faces downward as shown in FIG. 2. The frame member 10 comprises the push handle 10*a* mounted thereon for allowing the user to press it by hand and the casing 3 including the latch body 11 inside, which couples with one side of the frame member 10. The push handle 10*a* is mounted on two fixed supports 13 on the rear inside the frame member 10. Two slots 13 are respectively located on both side walls of each fixed support 13 for a sliding shaft 13*b* to be positioned in-between and further fixed on the side walls of the push handle 10*a* by a pin 13*c* on each end. Moreover, a spiral spring 13*d* is secured on the front rear of the fixed support 13 by a set pin 13*e*. Under normal conditions, the spiral spring 13*d* has one end abutting on the backside of the sliding shaft 13*b* applying an upward pressure thereon. When the push plate 10*a* is pressed down by hand, the sliding shaft 13*b* is forced to move inwards along the slots 13*a*, receiving the push handle 10*a* inside the frame member 10.

Referring to a dotted-line circle in FIG. 3, an actuating piece 13 mounted inside the casing 3 towards the front end of the frame member 10, has a driving portion 12*a* extended on one end and a passive portion 12*b* oppositely extended on the other end. The driving portion 12*a* has one end abutting on the inner part of the push handle 10*a*; whereas the passive portion 12*b* is in contact with a recess portion 11*a* inside the latch body 11 mounted in the casing 3. Hence, when the push handle 10*a* is pressed down, the driving portion 12*a* of the actuating piece 12 is forced to move downwards, thereby leveraging and impelling the passive portion 12*b* thereof on the other side to travel upwards. As the passive portion 12*b* moves, the end thereof abuts against the recess portion 11*a* of the latch body 11 causing the latch body 11 to turn in a counterclockwise direction; the latch body 11, as a result, is withdrawn into the inside of the casing 3 enabling the fire-blocking door lock 1 to be unlatched.

According to FIGS. 2 and 3, the inner structure of the casing 3 of the fire-blocking door lock 1 comprises a latching member 15 including both the previously mentioned latch body 11 and a safety latching member 14 mounted thereon, and a plate member 16 at the bottom of the latching member 15 to be mounted thereon. A pin 17 is utilized to pivotally couple the safety latching member 14 and the latch body 11 together on the top of the latching member 15, thereby enabling both the safety latching member 14 and the latch body 11 to pivot inside the latching member 15 round pin 17. The structure further enables spiral springs 18 and 19, respectively, to be pivoted at both sides of the latch body 11 by the pin 17.

Moreover, the spiral spring 18 has one end elastically pressed against the top of the latching member 15, and the other end elastically pressed against one end of the safety latching member 14. This allows the safety latching member 14 to protrude outside the latching member 15 when no external force is applied to the push handle 10*a*. The spiral spring 19 has one end pressing against the top of the latching member 15, and the other end thereof pressing against the inside of the recess portion 11*a* of the latch body 11. This also allows the latch body 11 to protrude outside the latching member 15 when no external force is applied to the push handle 10*a*.

The safety latching member 14 of the fire-blocking door lock 1 further comprises a boss 14*a* on the side of the latch body 11. The boss 14*a* is abutted on an extended tongue-like piece 12*c* on the front of the passive portion 12*b* of the actuating piece 12, and a pin 20 is utilized to allow the actuating piece 12 to pivot on the latching member 15. Moreover, the fire-blocking door lock has a spiral spring 22 secured by a pin 21, which presses against the top of the actuating piece 12. This allows the actuating piece 12 to be positioned in a downward direction while no external force is being applied. In addition, the tongue-like piece 12*c* of the passive portion 12*b* and the boss 14*a* of the safety latching member 14 are pressed against each other. When the fire-blocking door is latched, the safety latching member 14 is pressed toward the doorframe and retracted to the inside of the latching member 15, thereby moving towards the inner latching member 15. Therefore, the boss 14*a* of the safety latching member 14 is disengaged from the position in contact with the tongue-like piece 12*c* on the front of the passive portion 12*b*. Consequently, the actuating piece 12 is forced downwards under elastic pressure by the spiral spring 22 so that the front end of the passive portion 12*b* of the actuating piece 12 is appropriately abutted against the inside of a stop portion 11*b* of the latch body 11. As a result, the latch body 11 can not be moved backwards and retracted into the latching member 15 due to the obstruction of the stop portion 11*b*. Therefore, the fire-blocking door 2 can be securely latched when the fire-blocking door lock 1 is under a normal lockup condition.

However, after being used over a long period of time, the structure of the fire-blocking door lock 1 result in a problem wherein a gap is formed between the door and doorframe when the door is latched; consequently, the safety latching member 14 is unable to be entirely retracted into the latching member 15. In addition, the boss 14 at one end of the safety latching member 14 is pressed against the tongue-like piece 12*c* on the passive portion 12*b* of the actuating piece 12. For this reason, when the actuating piece 12 is forced downwards by the spiral spring 22, the actuating piece 12 fails to reach to the lowest horizontal position, so that the fire-blocking door lock 1 can not be opened as the front of the passive portion 12*b* of the actuating piece 12 fails to be entirely abutted on the inside of the stop portion 11*b* of the latch body 11.

Furthermore, when the fire-blocking door 2 is subject to a strike, the latch body 11 will vibrate; so as to make the front end of the passive portion 12*b* of the actuating piece 12 disengage from the stop portion 11*b* of the latch body 11. This leads to the problem that both the actuating piece 12 and the latch body 11 fail to press against each other, and consequently the latch body 11 becomes loose and is easily retracted into the latching member 15. Hence, the fire-blocking door lock 1 is unable to maintain the lockup status.

Moreover, if the latch body 11 is intentionally broken, the latch body 11 would then be retracted into the latching member 15 and the fire-blocking door lock 1 would also be unable to maintain the lockup status. In this case, the blocking effect on the fire-blocking door lock could fail.

In addition, a safety release unit 23 is positioned on the fire-blocking door lock 1 adjacent to a side wall of the latching member 15. The safety release unit 23 further includes a retaining ring 26 thereon abutting on a hot-melt tube 24, which is made of a hot-melt material and can be melted away at the temperature of flames. In addition, the safety release unit 23 further includes a spiral spring 25 positioned on the latching member 15. The spiral spring 25 has one end pressed against the side wall of the latching member 15 and has the other end pressed against the protruding inner end 23*b* of the safety release unit 23. The hot-melt tube 24 is in between the outer end 23*a* of the safety release unit 23 and the side wall of the latching member 15; the spiral spring 25 is sleeved on the safety release unit 23 in a compressed condition and can generate a backward propulsive force on the inner end 23*b* of the safety release unit 23. When the fire-blocking door lock 1 is under high heat due to a fire, the hot-melt tube 24 melts away at the temperature of flames, resulting in the blocking effect rendered by the safety release unit 23 without restraint of the hot-melt tube 24. Consequently, the safety release unit 23 is forced to protrude backwards by the elasticity of the compressed spiral spring 25.

In that the inner end 23*b* of the safety release unit 23 is extended into the latching member 15 and forced against the edge of the recess portion 11*a* of the latch body, the latch body 11 is not retractable; that is, the latch body 11 can not be withdrawn into the inside of the latching member 15 such that the fire-blocking door lock 1 maintains a secure lockup. This prevents the fire-blocking door 2 from being opened by someone unaware of a fire, thereby preventing burns to people and the spread of flames.

However, when the conventional fire-blocking door lock 1 is under the high temperature of fire, the hot-melt tube 24 positioned on the safety release unit 23 melts away a glutinous liquid; therefore the spiral spring 25 and the safety release unit 23 easily glue together, thus diminishing the backward elasticity of the safety release unit 23. Subsequently, the safety release unit 23 either can not be trusted to enter the recess portion 11*a* of the latch body 11, or it becomes sluggish, prolonging the reaction time for latching the fire-blocking door 2.

In summary, a variety of drawbacks in a conventional fire-blocking door lock structure cause the problem of failing to surely latch the fire-blocking door lock 1. In addition, the structure is unable to cause the fire-blocking door to be securely closed under the lockup condition, or would lengthen the reaction time for effecting the lockup of the door during-a fire. Moreover, the drawback of failing to maintain the lockup status of the fire-blocking door would seriously affect the fire-blocking effect of the fire-blocking door lock. It is obvious that the drawbacks of a conventional fire-blocking door lock structure with regard to the fire-blocking operation need to be overcome.

SUMMARY OF THE INVENTION

An objective of the present invention is to provide a fire-blocking door lock structure having a latch body that can be securely latched to maintain a lockup status of the lock structure when the fire-blocking door is closed.

Another objective of the present invention is to provide a fire-blocking door lock structure having a fire-blocking piece that melts at a high temperature such as in a fire, such that the latch body is blocked by a stop piece and cannot be moved, so as to assure lockup of the fire-blocking door and eliminate the possibility that the door lock is accidentally unlatched or opened by someone who is unaware of the fire.

To achieve the above and other objectives, the fire-blocking door lock structure of the present invention comprises a latching member mounted in a lock casing on a fire-blocking door lock, and an actuation mechanism mounted in the latching member. The actuation mechanism comprises a latch body, a stop piece, a safety latching member, a guide rod, and an actuating piece. The latch body can swing smoothly and is formed with a stop portion. The stop piece prevents retraction of the latch body and is connected to a fire-blocking piece. When the safety latching member abuts against one side of the stop piece, the safety latching member can prevent the latch body from retraction into the latching member. The guide rod enables the latch body to be blocked by the fire-blocking piece. The actuating piece guides both the latch body and the guide rod in motion by an external force.

The latching member is mounted in the lock casing on the fire-blocking door, which comprises a push handle and a latch body driven by the push handle. A person can unlatch the latch body by pressing the push handle that is subsequently forced to contact the actuation mechanism of the latching member.

Both the safety latching member and the stop piece can pivot or swing smoothly on the latching member. The safety latching member can abut against one side of the stop piece. The fire-blocking piece is formed on an upright portion of the stop piece. The guide rod penetrates the actuating piece to be coupled to the fire-blocking piece connected with the stop piece. As a result, the fire-blocking piece can be pushed to an upper position by forward motion of the guide rod. The latch body pivots and is received within the latching member, allowing the guide rod to abut against the fire-blocking piece and moved toward the latch body. The stop piece, which is coupled to the fire-blocking piece, can move downwards without blocking the stop portion, such that the latch body can be retracted into the latching member to unlatch the fire-blocking door. When the fire-blocking piece melts at a high temperature, the stop piece blocks the stop portion such that the latch body fails to be retracted into the latching member, making the fire-blocking door kept being locked.

The stop piece is mounted in the latching member and has one end thereof connected to an elastomer such as spiral spring, to allow the stop piece to move upwards by elastic extension of the spiral spring, while the other end of the stop piece is engaged with a stop bolt formed at the bottom of the safety latching member. The stop portion, which is formed at the bottom of the latch body, abuts against the stop piece and is held in the latching member.

When the fire-blocking door is locked, the safety latching member contacts the doorframe and is retracted backwards. One end of the stop piece is forced to move upwards by elasticity of the spiral spring, while the other end of the stop piece is kept being engaged with the stop portion of the latch body. When the fire-blocking door lock structure is subject to a fire, the fire-blocking piece melts under a high temperature during the fire, allowing the latch body to be blocked from motion by the stop piece, thereby maintaining the lockup status of the fire-blocking door.

The stop piece moves upwards to a position corresponding to the stop portion formed at a rear end of the latch body. Therefore, when the latch body intends to move backwards and be retracted into the latching member, the stop portion is blocked by the stop piece, making the latch body not able to move, such that the lockup status of the fire-blocking door lock structure is maintained.

The guide rod can be move upwards by turning clockwise a passive portion of the actuating piece, to allow the guide rod to abut against the fire-blocking piece and move towards the latch body, such that the stop piece, which is coupled to the fire-blocking piece, is moved downwards. As a result, the stop piece would not block the stop portion of the latch body, and accordingly the latch body can be retracted into the latching member by the upward pressure from the passive portion of the actuating piece, thereby releasing the lockup of the fire-blocking door lock structure to open the fire-blocking door.

When the fire-blocking door lock structure is subject to a fire, the fire-blocking piece coupled to the stop piece melts under a high temperature during the fire. The guide rod fails to abut against the melted fire-blocking piece, making the stop piece moved upwards by the elasticity of the spiral spring. As such, a front end of the stop piece is positioned corresponding to the stop portion of the latch body and thus blocks the stop portion, such that the latch body is prevented form retraction into the latching member. This thereby keeps the fire-blocking door lock structure being latched, so as to prevent the fire-blocking door from being opened by someone who is unaware of the fire and avoid damage from spread of flames.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENTS

Figure 1:
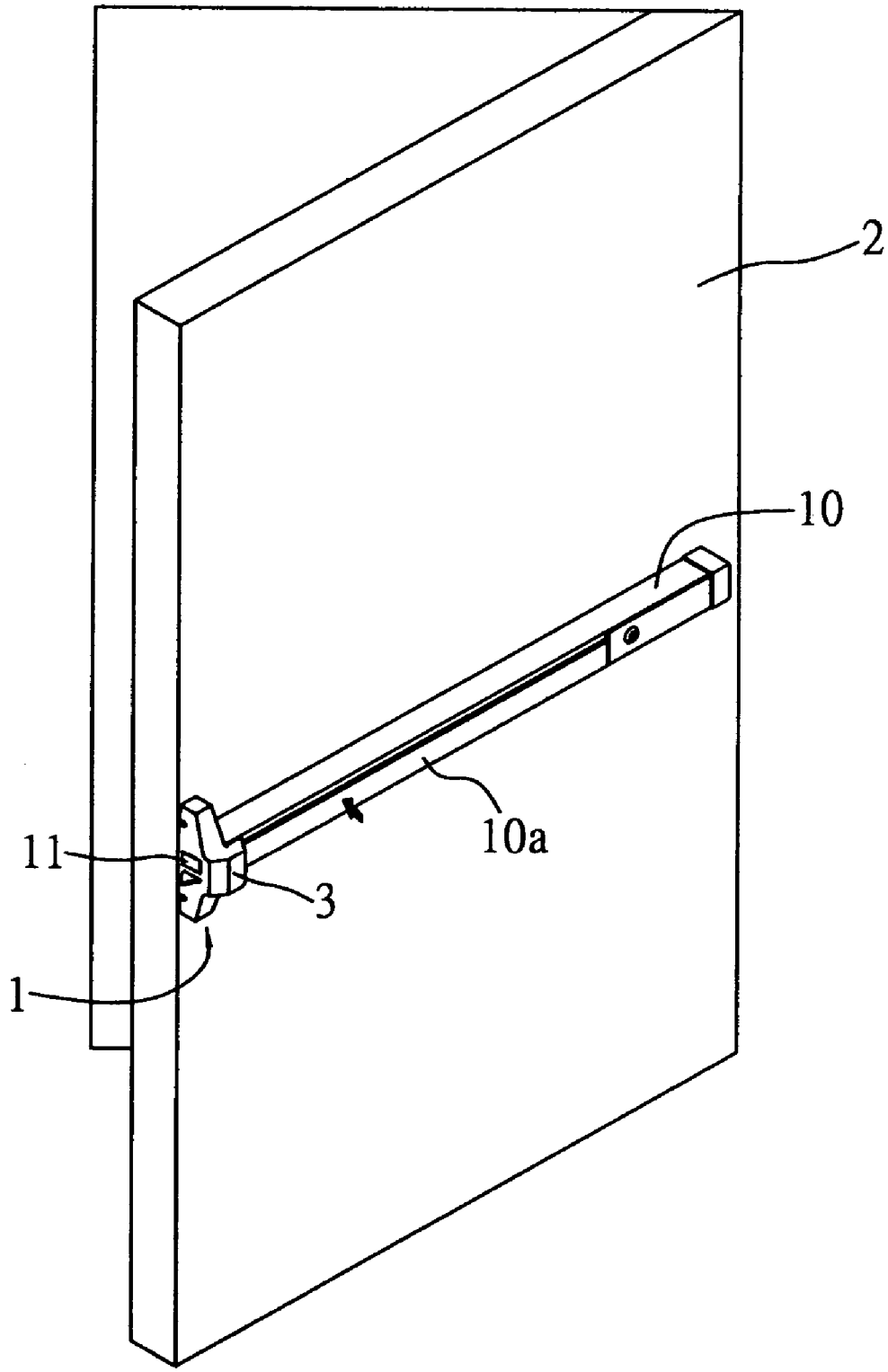
FIG. 1 (PRIOR ART)
FIG. 1 (PRIOR ART) is a perspective view of a conventional fire-blocking door lock.
Figure 2:
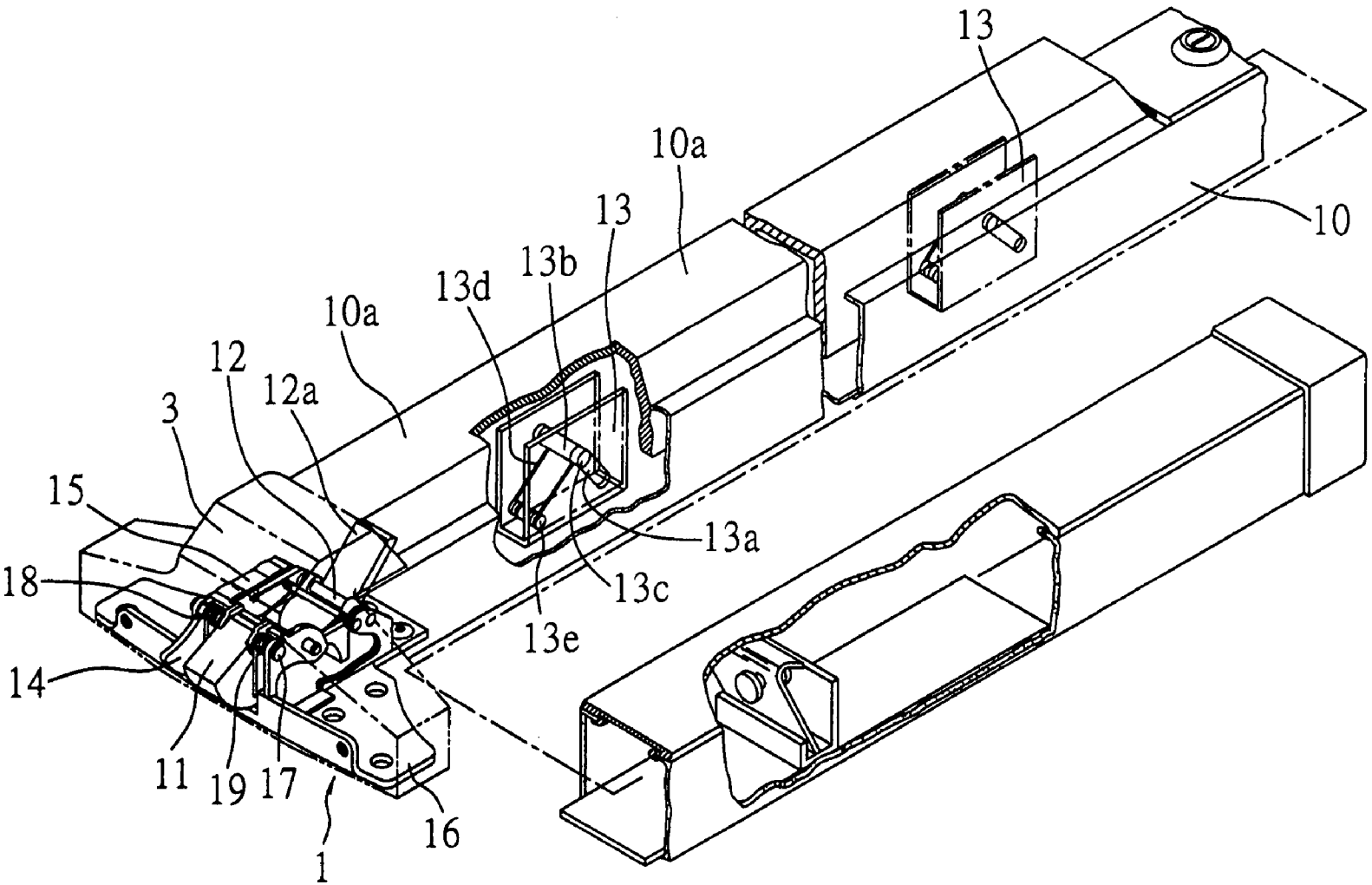
FIG. 2 (PRIOR ART)
FIG. 2 (PRIOR ART) is a structural diagram of a conventional fire-blocking door lock.
Figure 3:
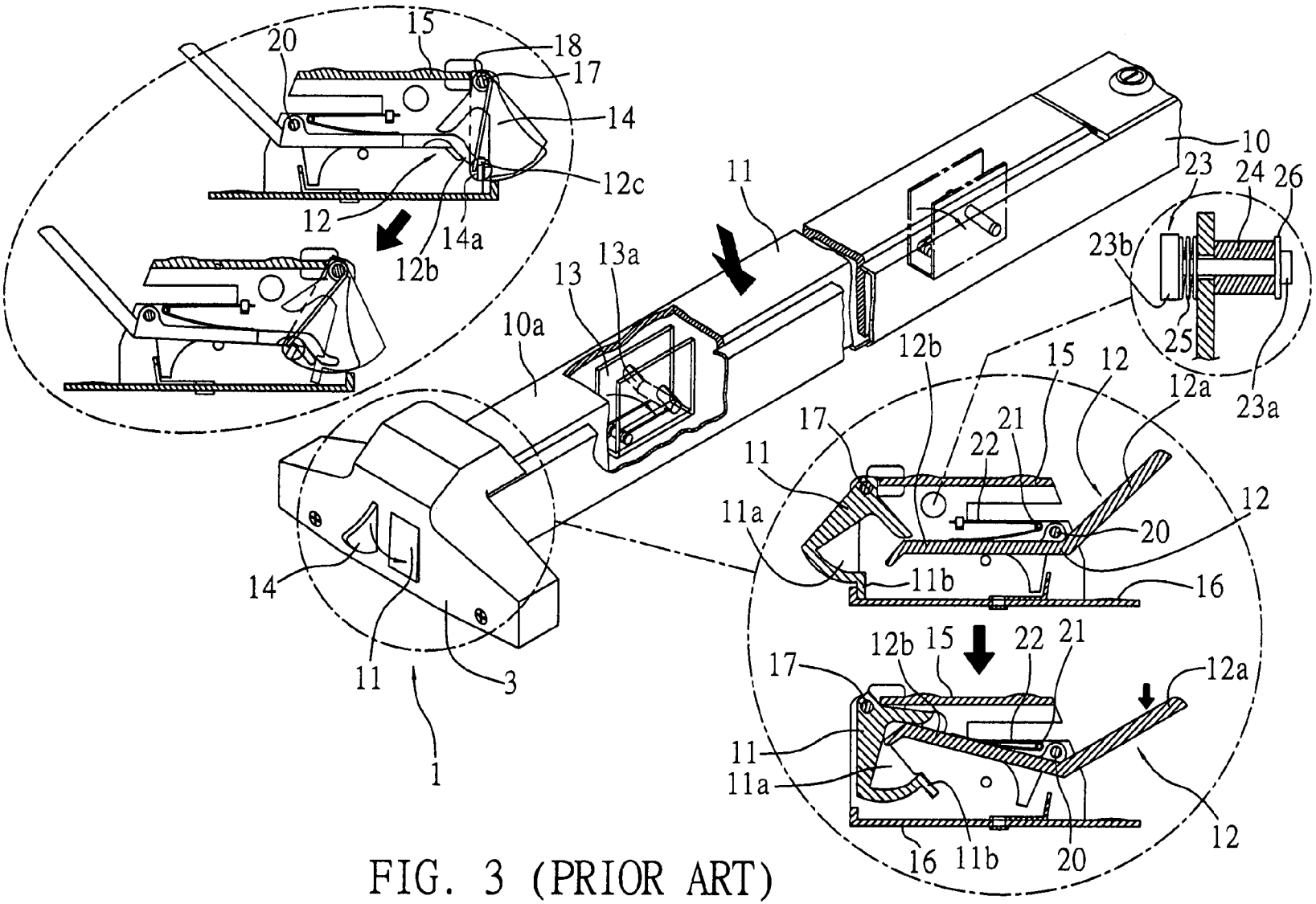
FIG. 3 (PRIOR ART)
FIG. 3 (PRIOR ART) is a perspective view showing the actuation of a conventional fire-blocking door lock.
Figure 4:
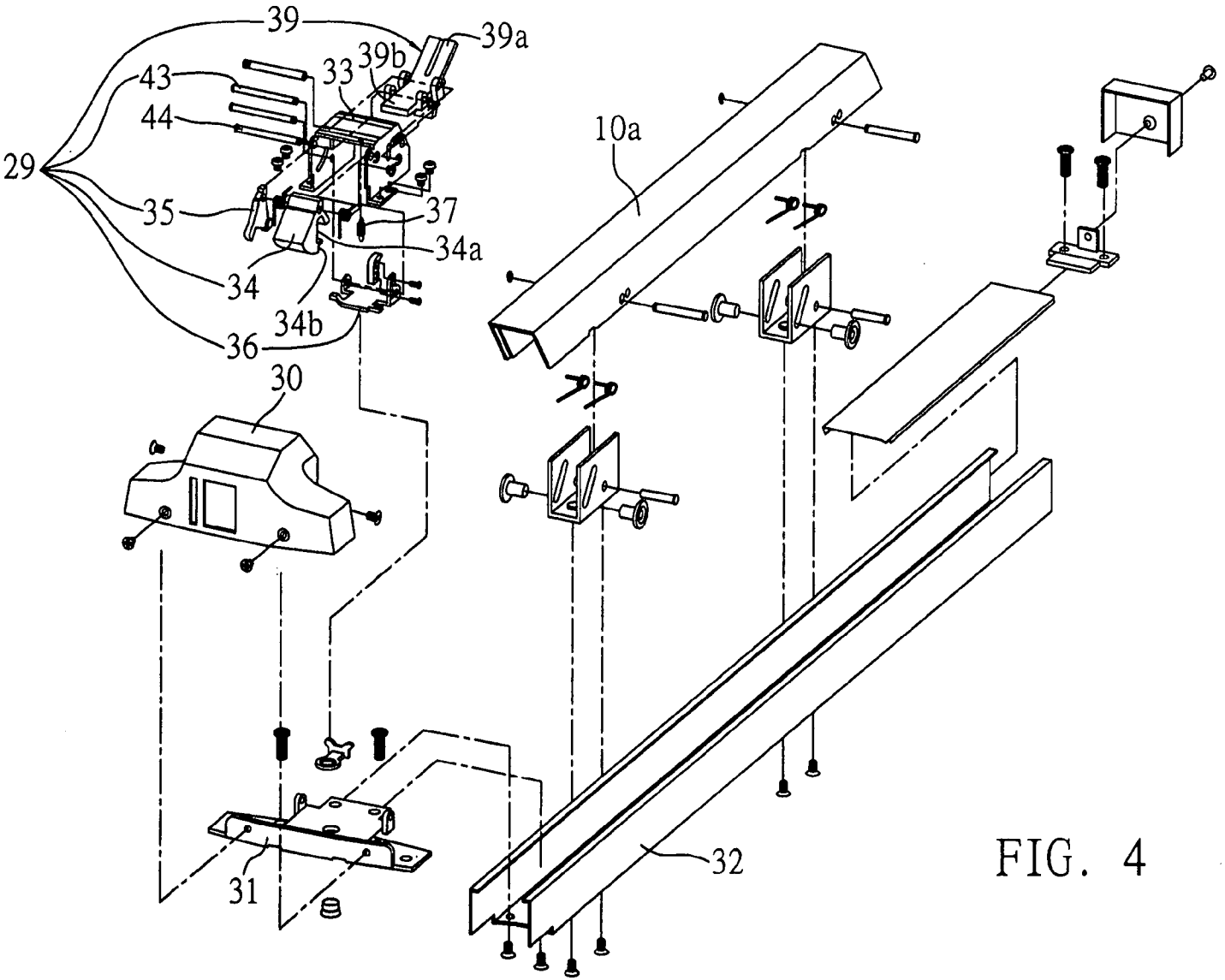
FIG. 4 is an exploded perspective view of a fire-blocking door lock structure according to the invention.
Figure 5:
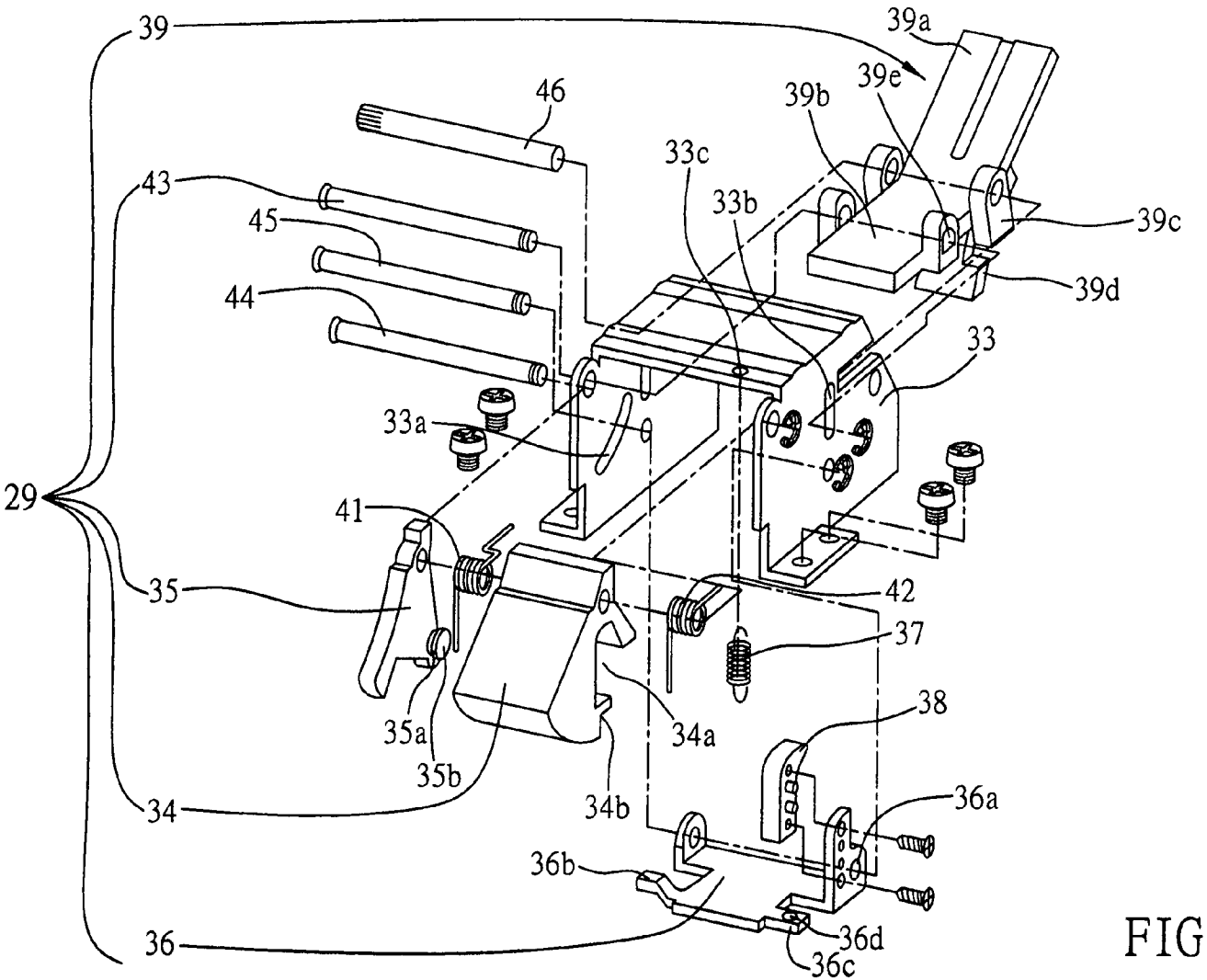
FIG. 5 is a partial perspective view showing the structure of a latching member according to the invention.

Referring to FIGS. 4 through 7, a fire-blocking door lock structure according to the present invention comprises a latching member 33 mounted in a lock casing 30 on a fire-blocking door (not shown) and an actuation mechanism 29 installed in the latching member 33. The actuation mechanism 29 comprises a latch body 34, a stop piece 36, a safety latching member 35, a guide rod 43 and an actuating piece 39. The fire-blocking door described in the embodiments of the invention is the same as the conventional fire-blocking door 2 shown in FIG. 1, thereby not further illustrated in the drawings herein.

The casing 3 is mounted on the fire-blocking door and comprises a push handle 10*a* and a latch body 34 driven by the push handle 10*a*. A person can unlatch the door by pressing the push handle 10*a* that is subsequently forced to contact the actuation mechanism 29. The latching member 33 is coupled to the casing 3 and pivotally connected with the safety latching member 35, the stop piece 36 and the guide rod 43. The safety latching member 35 can abut against a first end 36*b* of the stop piece 36. The stop piece 36 is formed with an upright portion 36*a* connected with a fire-blocking piece 38. The guide rod 43 is allowed to abut against the fire-blocking piece 38, such that the stop piece 36 can be moved upwards by forward motion of the guide rod 43. The latch body 34 pivots and is received in the latching member 33; the latch body 34 has a recess portion 34*a* formed at a rear end thereof, and a stop portion 34*b* able to be blocked by the stop piece 36.

The bottom of the latching member 33 is mounted on a plate member 31. The latch body 34 and the safety latching member 35 are movably pivoted to the latching member 33. The safety latching member 35 is formed with a stop bolt 35*a* at the bottom thereof. The stop piece 36 is also movably pivoted to the latching member 33. The first end 36*b* on one side of the stop piece 36 abuts against the stop bolt 35*a* of the safety latching member 35. An elastomer 37 has one end coupled to the stop piece 36 and the other end coupled to the top of the latching member 33, so that the stop piece 36 can be forced to move upwards by the elastic force of the elastomer 37.

A pin 44 penetrates the latching member 33 to pivotally couple the latch body 34 and the safety latching member 35 to the latching member 33. The pin 44 is sleeved with a first spiral spring 41 between the safety latching member 35 and the latch body 34, and further sleeved with a second spiral spring 42 between the latch body 34 and a side wall of the latching member 33. The first spiral spring 41 has one end tensioned against a boss 35*b* formed on the stop bolt 35*a* at the bottom of the safety latching member 35, and the other end tensioned against the top of the latching member 33. The second spiral spring 42 has one end tensioned against the inside of the recess portion 34*a* at the rear end of the latch body 34, and the other end tensioned against the top of the latching member 33. This allows the latch body 34 and the safety latching member 35 to extend out of the latching member 33 due to the elastic force from the first spiral spring 41 and the second spiral spring 42.

The boss 35*b* on the safety latching member 35 further penetrates a curved slot 33*a* on the side wall of the latching member 33, to allow the safety latching member 35 to swing smoothly and be retracted into the latching member 33. Moreover, the stop bolt 35*a* is allow to abut against the first end 36*b* of the stop piece 36 to maintain the safety latching member 35 at a bias position to move downwards.

The latching member 33 further comprises the actuating piece 39 pivoted thereon by means of the guide rod 43. The actuating piece 39 has one end forming a driving portion 39*a* and the other end forming a passive portion 39*b*. The driving portion 39*a* abuts against an inner part of the push handle 10*a*, and the passive portion 39*b* is in contact with the recess portion 34*a* of the latch body 34. At least one first pivot stand 39*c* is formed on the central top of the actuating piece 39, allowing a pivoting pin 46 to penetrate the first pivot stand 39*c* to pivot the first pivot stand 39*c* to the latching member 33, making the actuating piece 39 able to pivotally move about the pin 46 in the latching member 33. At least one second pivot stand 39*d* is formed on the top of the passive portion 39*b* of the actuating piece 39, allowing the guide rod 43 to penetrate the second pivot stand 39*d* to be coupled to the latching member 33 and able to slide up and down.

A lateral oval-shaped aperture 39*e* is formed through the second pivot stand 39*d*, for accommodating the guide rod 43 therein. An upright oval-shaped aperture 33*b* is formed through the latching member 33, for being coupled to the guide rod 43.

Figure 6:
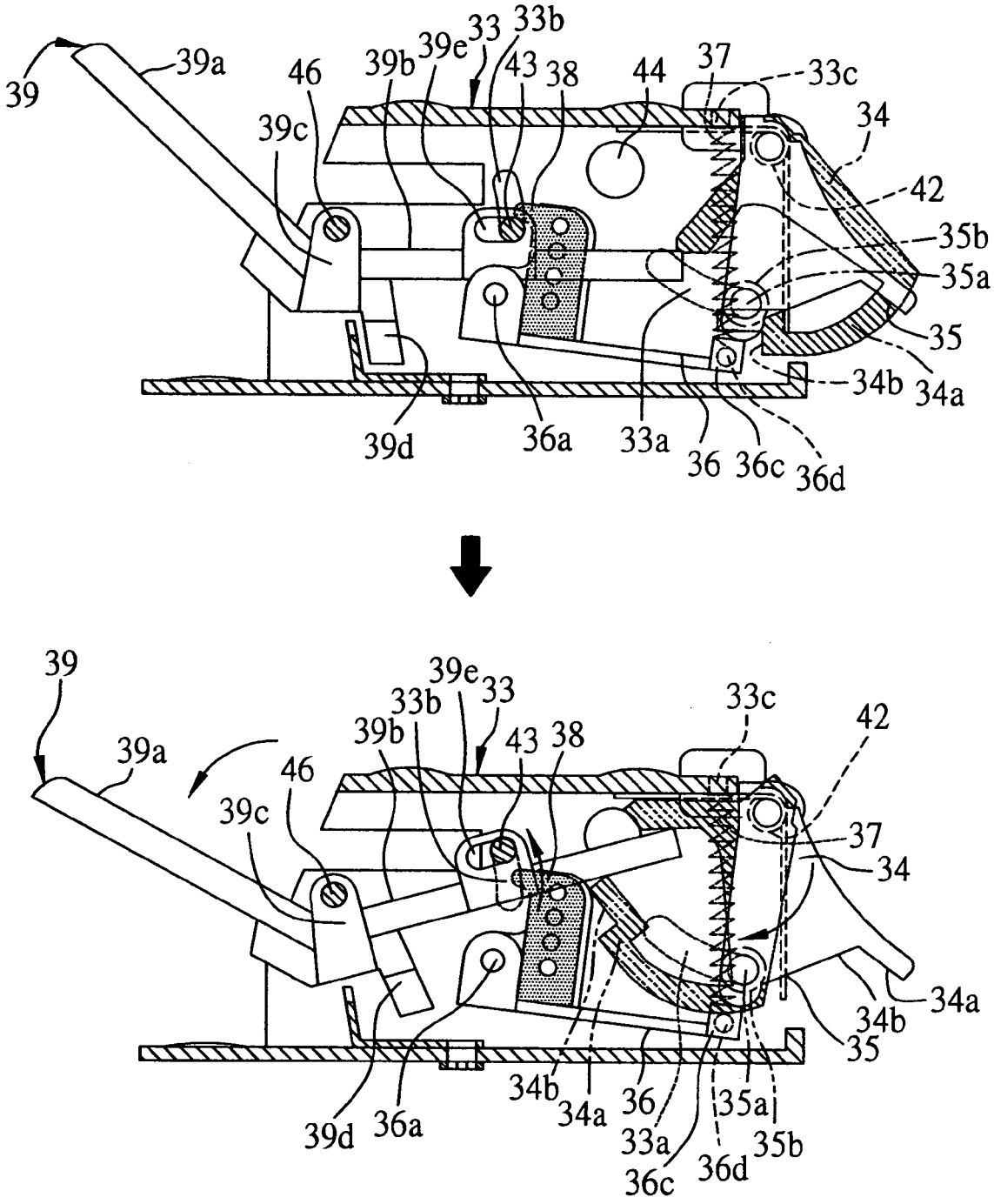
FIG. 6 is a perspective view showing the actuation of a latch body and a stop piece before a fire-blocking piece melts according to the invention.

Referring to FIG. 6, when the push handle 10*a* is pressed down by hand, the driving portion 39*a* of the actuating piece 39 is forced to move downwards, while making the passive portion 39*b* on the other end of the actuating piece 39 move upwards. Consequently, the guide rod 43 penetrating the second pivot stand 39*d* on the top of the passive portion 39*b* is shifted upwards to press on the fire-blocking piece 38 and thus drives the stop piece 36 connected to the fire-blocking piece 38 to move downwards, such that the passive portion 39*b* of the actuating piece 39 is engaged with the recess portion 34*a* of the latch body 34. Therefore, the stop piece 36 has its front end moving downwards without blocking the stop portion 34*b* of the latch body 34, such that the lockup of the fire-blocking door lock structure can be removed to open the door.

When the push handle 10*a* is released not being pressed, the latch body 34 is pressed by a force from upward movement of the actuating piece 39 and extended out of the latching member 33. At this time, the stop portion 34*b* at the rear end of the latch body 34 is blocked by the stop piece 36, making the latch body 34 unable to move backwards and be retracted into the latching member 33. This allows the fire-blocking door lock structure to be kept locked even in case of unexpected disengagement of the latch body 34.

A pin 45 penetrates the latching member 33 to pivotally mount the stop piece 36 in the latching member 33. The stop piece 36 has one side forming the first end 36*b* abutting against the stop bolt 35*a* on the bottom of the safety latching member 35, and the other end forming a second end 36*c*, wherein the second end 36*c* is formed with a round hole 36*d* for coupling one end of the elastomer 37, while the other end of the elastomer 37 is coupled to a round hole 33*c* formed on the top of the latching member 33.

The elastomer 37 can be a spiral spring, which can produce an elastic force to allow the stop piece 36 to move upwards.

The upright portion 36*a* is located at a rear portion of the second end 36*c* of the stop piece 36, and the fire-blocking piece 38 is coupled to an upright side wall of the upright portion 36*a*. The fire-blocking piece 38 is made of a material melting at a high temperature. When the fire-blocking piece 38 is blocked by the guide rod 43, the stop piece 36 is moved downwards and its front end would not block the stop portion 34*b* of the latch body 34. Therefore, the lockup of the fire-blocking door lock structure can be released when a person presses the push handle 10*a*.

Figure 7:
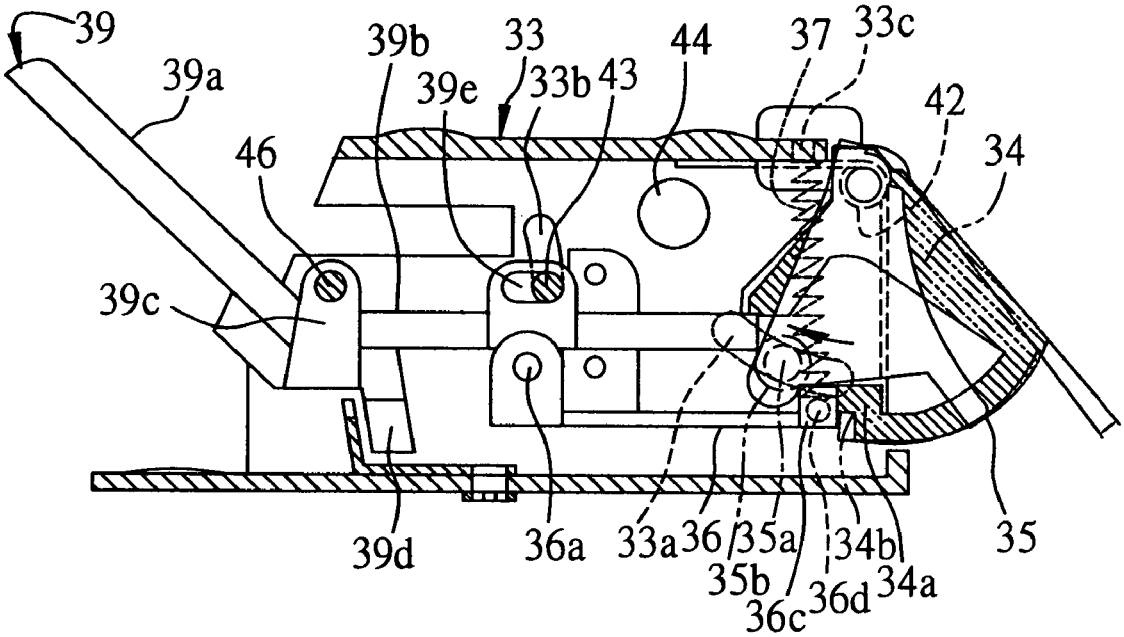
FIG. 7 a perspective view showing the actuation of the latch body and the stop piece after the fire-blocking piece melts according to the invention.

As shown in FIG. 7, When the fire-blocking door lock structure is subject to a fire, the fire-blocking piece 38 coupled to the stop piece 36 melts at a high temperature of the fire. As a result, the blocking from the guide rod 43 on the fire-blocking piece 38 is removed, and the stop piece 36 is forced to move upwards by the elastic extension of the elastomer 37, making the front end of the stop piece 36 reach a position corresponding to the stop portion 34*b* of the latch body 34, such that the latch body 34 is blocked by the stop piece 36 and prevented from retraction into the latching member 33. At this time, the lockup of the fire-blocking door lock structure cannot be released even if a person presses the push handle 10*a*. The blocking or engagement between the stop portion 34*b* of the latch body 34 and the stop piece 36 is strongly secured without being easily or possibly released. This assures the fire-blocking door to be closed instead of being opened by someone who is unaware of the fire, such that damage from spread of the flames can be avoided.

In conclusion, the use of the fire-blocking door lock structure according to the invention allows the fire-blocking door to be smoothly opened when pressing the push handle 10*a*. In case of a fire, the fire-blocking door lock structure is subject to a high temperature of the fire and allows the fire-blocking door to be well maintained in a closed or lockup condition by the firm and strong engagement between the stop portion 34*b* of the latch body 34 and the stop piece 36, such that the fire-blocking door is prevented from being opened by someone who is unaware of the fire and thus not injured by the flames.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A fire-blocking door lock structure, comprising:

a latching member mounted in a lock casing to be mounted on a fire-blocking door; and an actuation mechanism mounted in the latching member, the actuation mechanism comprising a latch body which swings smoothly and is formed with a stop portion;

a stop piece which prevents retraction of the latch body and is connected to a fire-blocking piece;

a safety latching member which prevents the latch body from retraction into the latching member when the safety latching member abuts against the stop piece;

a guide rod for allowing the latch body to be blocked by the fire-blocking piece when the safety latching member abuts against the stop piece;

an actuating piece for guiding the latch body and the guide rod in motion by a force, to allow the latch body to be retracted into the latching member to open the fire-blocking door when the stop piece fails to block the stop portion, and allow the stop piece to be blocked by the stop portion when the fire-blocking piece melts under a high temperature, so as to prevent the latch body from retraction into the latching member and assure lockup of the fire-blocking door; and a boss penetrating the bottom of the safety latching member and a slot formed on a side wall of the latching member, to allow the safety latching member to be retracted into the latching member;

the boss having a stop bolt penetrating the safety latching member;

the stop piece having one side formed with a first end and the other side formed with a second end, allowing the first end to abut against the stop bolt of the boss to maintain the safety latching member at a bias position to move downwards, the second end being coupled to one end of an elastomer, with the other end of the elastomer being coupled to the top of the latching member, making the stop portion move upwards by elastic extension of the elastomer; and the stop piece having an upright portion formed on the second end thereof, allowing the fire-blocking piece to be coupled to an upright side wall of the upright portion.

2. The fire-blocking door lock structure of claim 1, wherein the stop piece is pivoted to the latching member by a pin penetrating the latching member.

3. The fire-blocking door lock structure of claim 1, wherein the latching member has its bottom mounted on a plate member.

4. The fire-blocking door lock structure of claim 1, wherein the latching member is formed with an upright oval-shaped aperture where the guide rod is pivoted.

5. The fire-blocking door lock structure of claim 1, wherein the stop portion is formed on a rear side of the latch body.

6. The fire-blocking door lock structure of claim 5, wherein the rear side of the latch body is further formed with a recess portion.

7. The fire-blocking door lock structure of claim 6, wherein the actuating piece has one end forming a driving portion and the other end forming a passive portion, to allow the latch body to be retracted into the latching member by pressure from the passive portion of the actuating piece.

8. The fire-blocking door lock structure of claim 7, wherein the driving portion is extended into and engaged with the recess portion of the latch body.

9. The fire-blocking door lock structure of claim 7, wherein the actuating piece is formed on its central top with a first pivot stand that is pivoted to the latching member by a pin penetrating the first pivot stand.

10. The fire-blocking door lock structure of claim 9, wherein a second pivot stand is formed on the top the passive portion, such that the guide rod penetrates the second pivot stand to be movably installed in the latching member.

11. The fire-blocking door lock structure of claim 10, wherein the second pivot stand is formed with a lateral oval-shaped aperture where the guide rod is inserted.

12. The fire-blocking door lock structure of claim 1, wherein a front end of the stop piece abuts against the stop portion of the latch body to allow the latch body to be pivoted to the latching member.

13. The fire-blocking door lock structure of claim 1, wherein the fire-blocking piece is a flat plate structure.

14. The fire-blocking door lock structure of claim 1, wherein the fire-blocking piece is made of a material melting at the high temperature.

15. The fire-blocking door lock structure of claim 7, wherein the guide rod abuts against the fire-blocking piece and moves towards the latch body, to allow the fire-blocking piece to move downwards, making the stop piece fail to block the stop portion of the latch body, such that the latch body is urged upwards by the passive portion of the actuating piece and retracted into the latching member, so as to release lockup of the lock structure and open the fire-blocking door.

* * * * *